US006394703B1

(12) United States Patent
Renouf

(10) Patent No.: US 6,394,703 B1
(45) Date of Patent: May 28, 2002

(54) FORMATION OF CAPPING BEAMS FOR PILES

(75) Inventor: Peter David Renouf, Bucks (GB)

(73) Assignee: Cementations Foundations Skanska Limited, Rickmansworth (GB)

( * ) Notice: Subject to any disclaimer, the term of this patent is extended or adjusted under 35 U.S.C. 154(b) by 0 days.

(21) Appl. No.: 09/720,837

(22) PCT Filed: Apr. 25, 1999

(86) PCT No.: PCT/IB00/00504

§ 371 (c)(1),
(2), (4) Date: Jan. 25, 2001

(87) PCT Pub. No.: WO00/65158

PCT Pub. Date: Nov. 2, 2000

(30) Foreign Application Priority Data

Apr. 26, 1999 (GB) ..... 9909506

(51) Int. Cl.[7] ..... E02D 27/14

(52) U.S. Cl. ..... 405/232; 405/255; 405/256; 405/257

(58) Field of Search ..... 405/232, 233, 405/243, 245, 255, 256, 257

(56) References Cited

U.S. PATENT DOCUMENTS 4,163,621 A * 8/1979 Higuchi ..... 405/255
4,165,198 A * 8/1979 Farmer ..... 405/243
5,259,705 A * 11/1993 Breaux et al. ..... 405/267
5,501,550 A * 3/1996 Calabrese ..... 405/232
5,713,701 A * 2/1998 Marshall ..... 405/232

FOREIGN PATENT DOCUMENTS

GB 2216153 A * 10/1989 ..... E04B/1/16
GB 2304136 A * 3/1997 ..... E02D/27/14
GB 23038688 A * 3/1997 ..... E02D/5/34
GB 2349395 A * 11/2000 ..... E02D/27/12

* cited by examiner

*Primary Examiner*—Thomas B. Will
*Assistant Examiner*—Alexandra K Pechhold
(74) *Attorney, Agent, or Firm*—Herbert Dubno

(57) ABSTRACT

A method and apparatus for forming a capping beam across two or more cast-in-situ piles (11), wherein a precast or preformed guide wall structure (1) having holes (5) for receiving and guiding a piling auger is placed into an excavation, forming a number of cast-in-situ piles (11) by applying a piling auger to the ground through the holes (5) in the guide wall structure (1), removing the guide wall structure (1) and filling the excavation with concrete so as to form a capping beam. This results in much improved construction times, since it is not necessary to remove excess hardened concrete before forming the capping beam, and also results in less waste, since the guide wall structure can be reused.

7 Claims, 2 Drawing Sheets

FORMATION OF CAPPING BEAMS FOR PILES

CROSS REFERENCE TO RELATED APPLICATION

This application is a national stage of PCT/IB00/00504 filed Apr. 25, 2000 and based upon UK national application 9909506.9 filed Apr. 26, 1999 under the International Convention.

FIELD OF THE INVENTION

The present invention relates to capping beams which are formed across the tops of piles in the construction industry, and in particular, but not exclusively, to an improved method and apparatus for forming a capping beam for piles formed using auger piling methods.

BACKGROUND OF THE INVENTION

It is known to construct subterranean walls by forming a series of adjoining or nearly adjoining concrete piles by using auger piling techniques such as continuous flight auger (CFA) auger piling, described in detail in U.K. patent application no. 9515652.7 (GB 2 303 868) the disclosure of which is incorporated into the present application by reference. Auger piling comprises the steps of rotating an auger into the ground, and then withdrawing the auger, with our without rotation, while pumping concrete to its lower end, thereby forming a concrete pile. A reinforcement member may be inserted into the concrete before it sets so as to provide additional structural strength.

There are three known methods of constructing such a wall. The simplest method is to form a contiguous bored pile wall, in which a series of piles are formed in a line but without touching one another. This is a relatively straightforward operation and the wall will not be watertight owing to the gaps between the piles.

An alternative technique is to form an interlocking bored pile wall. In this technique, a series of 'female' piles are formed in the desired line of the wall and concreted with a weak concrete mix. No reinforcements are used. A complementary series of 'male' piles is then formed by boring down at the midpoint between two adjacent female piles, thereby cutting into the weak concrete mix. Each male pile is then concreted and reinforced in the usual manner, so as to leave a series of reinforced, hard concrete piles with the gaps therebetween filled by the weak concrete female piles. This is a great improvement over the contiguous bored pile technique, but does require a great deal of vertical piling accuracy and is still not entirely watertight owing to the properties of the weak concrete of the female piles.

The technique which results in the highest structural integrity is known as secant wall piling. This is similar to the interlocking bored pile wall construction method outlined above, but strong concrete is used for both the female and the male piles. This means that when forming the male piles, it is necessary for the piling auger to remove concrete from the hardened female piles. This is a difficult and time-consuming process, resulting in significant wear on the piling auger. However, the result is a wall which has excellent integrity against water penetration.

In all these methods, and also in general piling applications where a group of piles are formed relatively close to one another, it is often desirable to install a capping beam across the tops of the piles at or close to ground level. This capping beam provides a sound, generally level surface upon which construction of a superstructure can take place, and is useful in seeking to equalize differential settlement or movement of the piles. Such beams are often of width larger than the pile diameter and typically have a depth of about 0.5 m.

It is possible to prepare previously-installed piles by forming a trench along the line of the piles, breaking the concrete away from the top of each pile and exposing the steel reinforcing elements so that a beam may be cast across several piles. This is an inefficient process and does not assist tolerance control of pile installation.

Often before piling commences, temporary guide walls are cast at ground level, to a depth corresponding approximately to the depth of the desired capping beam, around commercially-available polystyrene spacers which replicate the expected profile of the finished wall. The polystyrene may then by removed before piling commences, or left in place to be broken up and pushed into the ground by the piling auger. The resulting guide walls are then used to help position the piling auger and to assist with tolerance control. This is particularly important when forming a wall by piling, since the component piles need to be as nearly parallel to one another as possible so as to achieve structural integrity in the composite wall. By providing guide walls, additional vertical stability during piling is achieved, although it is to be remembered that the piling auger may still be subject to uneven lateral forces during penetration due to the prevalent ground conditions. When the piles have been completed, the temporary guide walls are removed, the tops of the piles are broken down and the reinforcing steel is exposed. Blinding (e.g. stone or concrete chippings) is then placed at ground level and shutters erected so as to form a casting mold for the required capping beam, which is then cast in a standard manner. This technique has a number of disadvantages. Firstly, it is time-consuming and costly to break down the hardened concrete from the tops of finished piles. Secondly, the guide walls are discarded, which is wasteful. Thirdly, the polystyrene spacers are generally over-sized, which means that the piling auger will tend to have a high degree of play within the guide walls—often as much as 10 cm or even more, which can lead to considerable positional inaccuracy with little lateral restraint. The reason that the polystyrene spacers are oversized is so as to ensure that once the temporary guide walls have been cast, there remains sufficient room between them to accommodate the piling auger. Finally, the polystyrene used for the spacers is not environmentally friendly and may contaminate the surrounding area upon disposal. Chemical removal of the polystyrene is even more undesirable, since this involves the use of organic solvents which can be toxic and damaging to the environment.

SUMMARY OF THE INVENTION

According to a first aspect of the present invention, there is provided a method of forming a capping beam across two or more piles, the method comprising the steps of:

i) forming an excavation in the ground;

ii) inserting a precast or preformed guide wall structure in the excavation, the guide wall structure including means for receiving and guiding a piling auger along its longitudinal axis at a plurality of locations in the guide wall structure;

iii) forming a plurality of cast-in-situ piles by applying a piling auger to the ground through the means for receiving and guiding the piling auger provided in the guide wall structure; and iv) removing the guide wall structure and filling the trench with concrete so as to form the capping beam.

Preferably, shuttering elements are provided between the guide wall structure and the sides of the excavation prior to piling so to precisely define a casting mold for the capping beam. The shuttering elements are left in place as the guide wall structure is removed, and concrete is cast into the space between the shuttering elements.

It is also preferable to apply blinding to the bottom of the trench so as to help define a surface layer which will become the bottom of the capping beam.

By employing a reusable, preformed or precast guide wall structure, the time and material waste involved in forming a cast-in-situ guide wall structure is saved, and the need for single-use polystyrene spacers is avoided. Furthermore, because the shuttering elements which determine the configuration of the resulting capping beam are put in place before commencement of piling, the need to break down the tops of hardened concrete piles prior to casting the capping beam is avoided. Excess concrete and spoil which may fall into the guide wall structure and/or between the shuttering elements can be removed before the concrete has hardened and deposited, for example, between the shuttering elements and the sides of the excavation as a filler.

In general, the shuttering elements are placed snugly on each external side of the guide wall structure. If a wider capping beam is desired, the shuttering elements may be placed at any desired location between the external sides of the guide wall and the sides of the excavation. Alternatively, if a narrower capping beam is required, spacers may be placed on the internal sides of the shuttering elements once the guide wall structure has been removed.

During piling, concreting is generally continued up to ground level as the auger is withdrawn, and a reinforcing member introduced before the concrete has hardened. It is desirable to cover those parts of the guide wall structure close to where piling is taking place so as to reduce the chances of spoil and/or excess concrete being spilled into areas where it is not required. Removal of excess spoil and/or concrete, for example to the region between the sides of the excavation and the shuttering elements, may be carried out manually or by a slurry pump or the like.

Once all the piles have been installed, the guide wall structure is removed and the capping beam concrete can be immediately cast between the shuttering elements. A reinforcing member may additionally be introduced. This can reduce the construction time by several weeks over traditional methods.

The method of the present invention is not limited to the formation of capping beams for piled walls, but may also be used in pile group capping applications. One or more piles can be grouped together and capped. For example a group of four piles may be cast so as to form the corners of a square, and a capping beam in the form of a large plate is then formed on top of the piles. The plate may be square, triangular, rectangular, circular, etc. as appropriate.

According to a second aspect of the present invention, there is provided a guide wall structure for use in forming capping beams, the guide wall structure comprising one or more preformed members which are provided with apertures adapted to receive and guide a piling auger along its longitudinal axis at a plurality of locations in the guide wall structure.

The guide wall structure may comprise a simple concrete or metal unit with holes provided therein for receiving and guiding a piling auger. This, however, is somewhat limiting in terms of the auger diameters which may be used and in terms of the locations of the piles which are to be capped.

Advantageously, therefore, the guide wall structure comprises at least two opposing wall members which are provided with retaining means on their facing surfaces, and at least one insert adapted to be releasably retained by the retaining means and shaped so as to define, individually or in combination, one or more apertures which are shaped so as to receive and guide a piling auger. Various inserts may be used with the same guide wall structure so as to accommodate augers of different diameters, and to allow a degree of positional flexibility depending on the distribution of the retaining means on the opposing surfaces of the wall members. The wall members may be formed of precast concrete or metal sheets or any other suitable material, as may be the inserts. The retaining means may comprise metal lugs or the like, or any other suitable arrangements for allowing the inserts to be removably located between the wall members without lateral movement.

Preferably, the at least one insert is shaped so as to provide an aperture for the piling auger which allows no more than 50 mm of lateral play when the piling auger is inserted therein. In some embodiments, the inserts may be shaped so as to allow no more than 25 mm, or no more than 10 mm, or even no more than 5 mm play. This level of accuracy is attainable because the inserts, in common with the guide wall structure as a whole, are not cast-in-situ but are preformed or precast under controlled conditions, thereby avoiding the constructional uncertainty inherent when working in the field. Accordingly, a much greater degree of positional piling accuracy and lateral auger restraint is achievable over the prior art.

BRIEF DESCRIPTION OF THE DRAWING

For a better understanding of the present invention and to show how it may be carried into effect, reference shall now be made by way of example to the accompanying drawing, in which.

SPECIFIC DESCRIPTION

Figure 1:
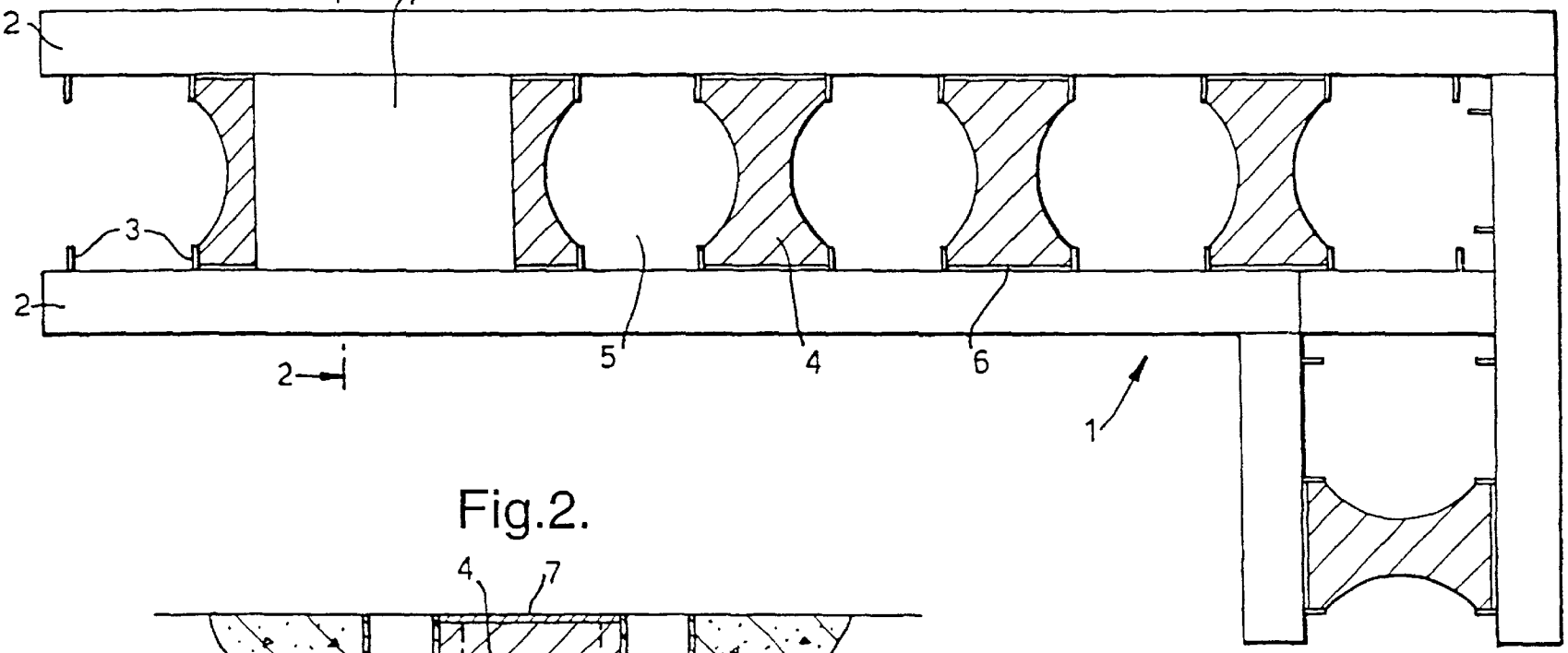
FIG. 1 shows a plan view of a guide wall structure according to the present invention.
Figure 2:
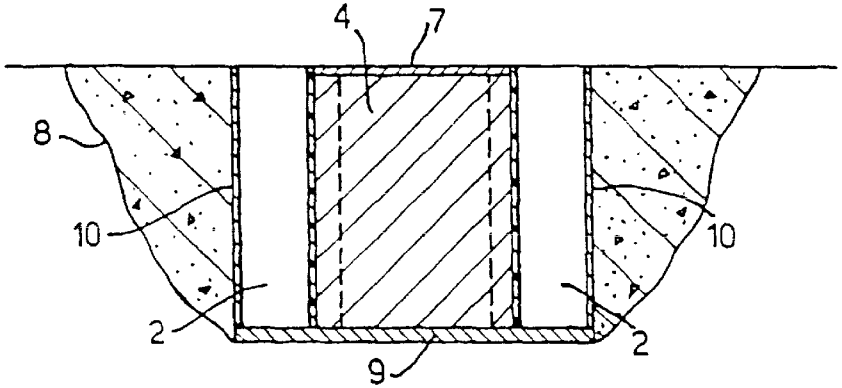
FIG. 2 shows a section through the structure of FIG. 1.
Figure 3:
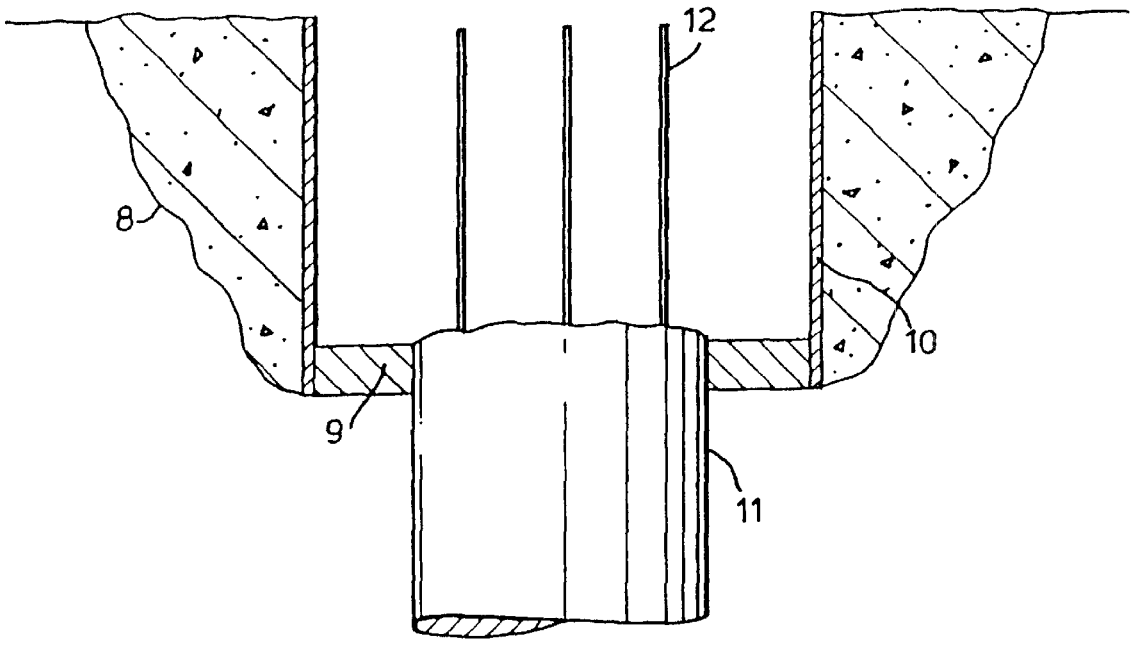
FIG. 3 shows a stage in the formation of a capping beam after the piles have been installed and the guide wall structure removed.

FIG. 1 shows a guide wall structure 1 comprising opposing wall members 2 each having a number of retaining lugs 3 on their opposed surfaces. The retaining lugs 3 are adapted to receive a number of inserts 4 between the wall members 2 in such a way that the inserts 4 can be removed but are not allowed significant lateral movement. The particular wall members 2 shown in FIGS. 1 and 2 are formed of precast concrete and are 300 mm thick, 500 mm deep and 3 m long, and are dovetailed at the ends so as to allow interlocking. The net weight of each member 2 is under 2000 kg, which allows for easy movement using commercial lifting equipment. It is to be appreciated that the wall members 2 may have any suitable dimensions.

The inserts 4 shown in the present embodiment have an hourglass section which, when two inserts 4 are located between adjacent pairs of retaining lugs 3, defines a circular aperture 5 which is adapted to receive a piling auger (not shown) along its longitudinal axis. Polystyrene gaskets 6 may be provided between the wall members 2 and the inserts 4. A removable cover 7 is provided so as to prevent ingress of concrete or spoil into adjacent parts of the guide wall structure 1 when piles are being installed.

FIG. 2 shows the guide wall structure 1 of FIG. 1 in section and located within a trench 8. The bottom of the trench is provided with blinding 9 so as to define the base of the capping beam, and a shuttering element 10 is positioned on each of the outer sides of the wall members 2. The gap between the outer sides of the shuttering elements 10 and the sides of the trench 8 may be infilled with weak concrete or spoil and concrete generated during the installation of piles.

A number of cast-in-situ piles 11 are then installed by applying a piling auger (not shown) to the ground through the apertures 5 and reinforcing members 12 are inserted into the unset concrete of the piles before the guide wall structure 1 is removed. Concrete is then poured into the space between the shuttering elements 10 as to form the required capping beam.

What is claimed is:

1. A method of forming a capping beam across two or more piles, the method comprising the steps of:

i) forming an excavation in the ground;

ii) inserting a precast or preformed guide wall structure in the excavation, the guide wall structure including means for receiving and guiding a piling auger along its longitudinal axis at a plurality of locations in the guide wall structure;

iii) forming a plurality of cast-in-situ piles by applying a piling auger to the ground through the means for receiving and guiding the piling auger provided in the guide wall structure;

iv) removing the guide wall structure and filling the excavation with concrete so as to form the capping beam.

2. A method according to claim 1, wherein shuttering elements are provided between the guide wall structure and the sides of the excavation prior to piling so as to define a casting mould for the capping beam.

3. A method according to claim 1, wherein blinding is applied to the bottom of the excavation before the piles are formed.

4. A method according to claim 2, wherein the shuttering elements are placed snugly on each external side of the guide wall structure.

5. A method according to claim 4, wherein spacer elements are placed on the internal sides of the shuttering elements after the guide wall structure has been removed and prior to filling the excavation with concrete.

6. A method according to claim 2, wherein the shuttering elements are placed at a location between each external side of the guide wall structure and the sides of the excavation.

7. A method according to claim 2, wherein excess concrete and spoil generated during piling is removed to a region between the sides of the excavation and the shuttering elements.

* * * * *